United States Patent [19]

Johansson et al.

[11] 4,299,074

[45] Nov. 10, 1981

[54] METHOD AND APPARATUS FOR COMPRESSING VOLUMINOUS MATERIAL EASY TO COMPRESS

[75] Inventors: Ingvar H. Johansson, Alvesta; Per-Olof Sanden, Billesholm; Pähr O. A. Holmgren, Katrineholm; Helle G. Johansson, Alvesta, all of Sweden

[73] Assignees: AB Maskinarbeten, Alvesta; Gullfiber AB, Billesholm, both of Sweden

[21] Appl. No.: 94,299

[22] Filed: Nov. 14, 1979

[30] Foreign Application Priority Data

Nov. 16, 1978 [SE] Sweden ..... 7811841

[51] Int. Cl.[3] ..... B65B 63/02

[52] U.S. Cl. ..... 53/529; 53/259; 100/211; 100/218

[58] Field of Search ..... 53/438, 473, 529, 259, 53/523, 530; 100/218, 211, 240

[56] References Cited

U.S. PATENT DOCUMENTS

| | | | |
|---|---|---|---|
| 3,117,513 | 1/1964 | Burnett | 100/218 |
| 3,118,455 | 1/1964 | Chalmers | 53/438 |
| 3,327,449 | 6/1967 | Hullhorst | 53/438 |
| 3,524,297 | 8/1970 | Falborg | 53/438 |
| 3,643,393 | 2/1972 | Togashi | 53/438 |
| 3,717,973 | 2/1973 | Brady, Jr. | 53/259 |
| 3,783,578 | 1/1974 | Willis | 53/438 |

*Primary Examiner*—John Sipos

*Attorney, Agent, or Firm*—Sherman & Shalloway

[57] ABSTRACT

The invention relates to a method and an apparatus for compressing voluminous material easy to compress and for storing and transporting the material in said compressed state. According to the invention, thus, there are provided a bottom and two opposed vertical walls capable to approach each other for compressing the material between the walls. When the material has been compressed to the desired volume the material is transferred to a storage or transport crate, which is located with its floor beneath the bottom and with its sides outside of and adjacent the walls. When the material is being discharged between the walls, it expands and presses against the side of the crate and an end side connected to the crate whereby the crate is moved with the material while being successively filled. When the material is being compressed it is pressed downward by a belt acting from above on the material.

7 Claims, 5 Drawing Figures

METHOD AND APPARATUS FOR COMPRESSING VOLUMINOUS MATERIAL EASY TO COMPRESS

This invention relates to a method and an apparatus for compressing voluminous material easy to compress and for transferring the material to a storage or transport crate. Examples of such material, to which the invention is especially applied, are building insulation materials in the form of bales or mineral wool sheets.

In a normal manufacturing method the building insulation material leaves the production line packed in bales, which for example are enclosed by plastic foil and have a length of about 1.5 m. The material is produced continuously for twenty-four hours a day, with only some short interruptions during the year, and every fifth second a bale leaves the production line.

It is easily understood that tremendous storage and transport problems are involved with this production. For temporary storage at the place of manufacture the bales heretofore have been placed loosely in large containers and stored in magazines or halls, the volume of which is adjusted to a calculated storage time (three to five days), which is substantial.

The present invention, as it is defined in the characterizing clauses of the attached claims, renders it possible to reduce the volume of the building insulation material prior to its storage and transport to about one third of the original volume of the bale when it leaves the production line.

Figure 1:
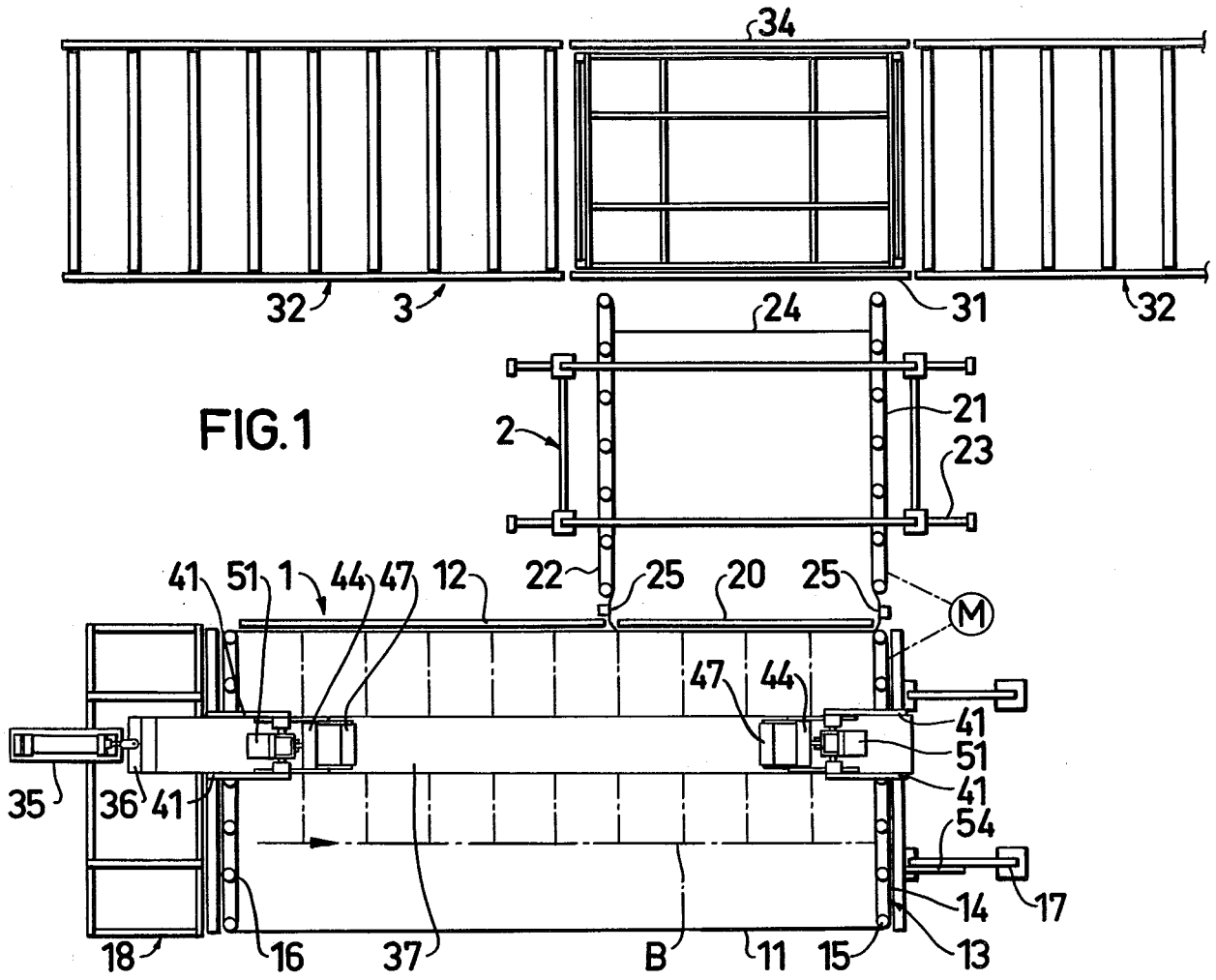
Figure 2:
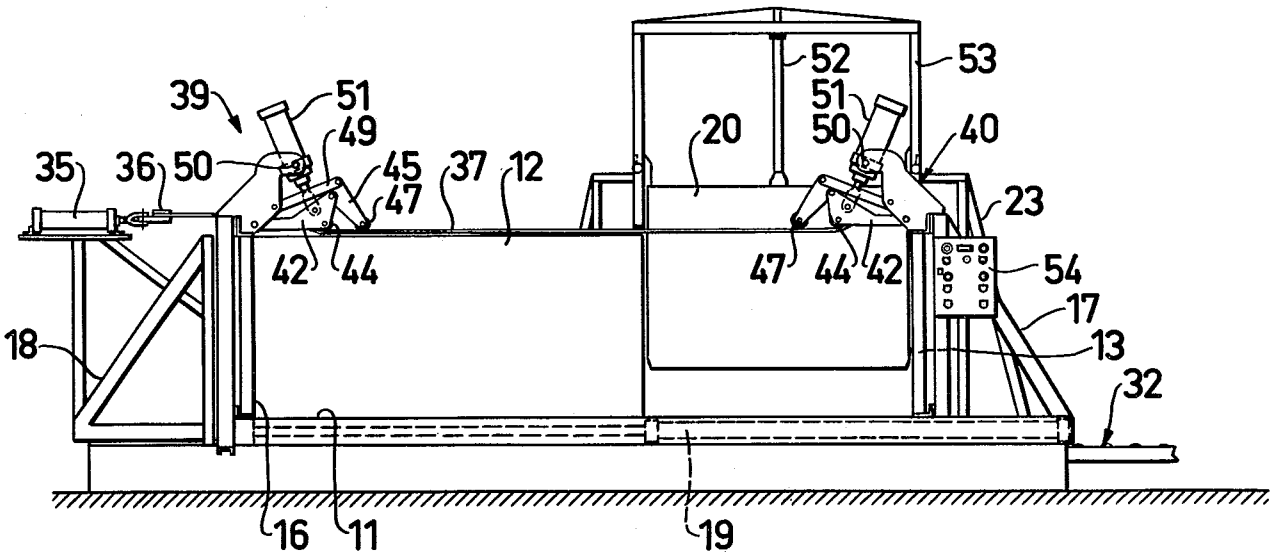
Figure 4:
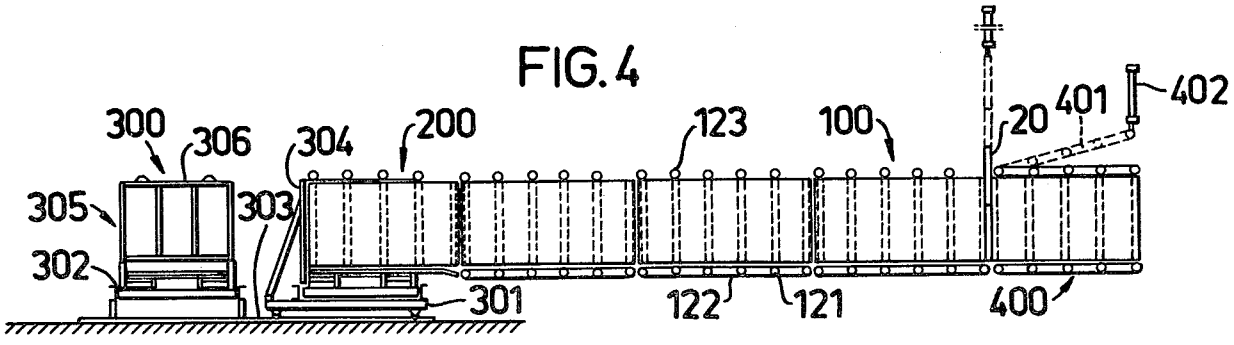
Figure 3:
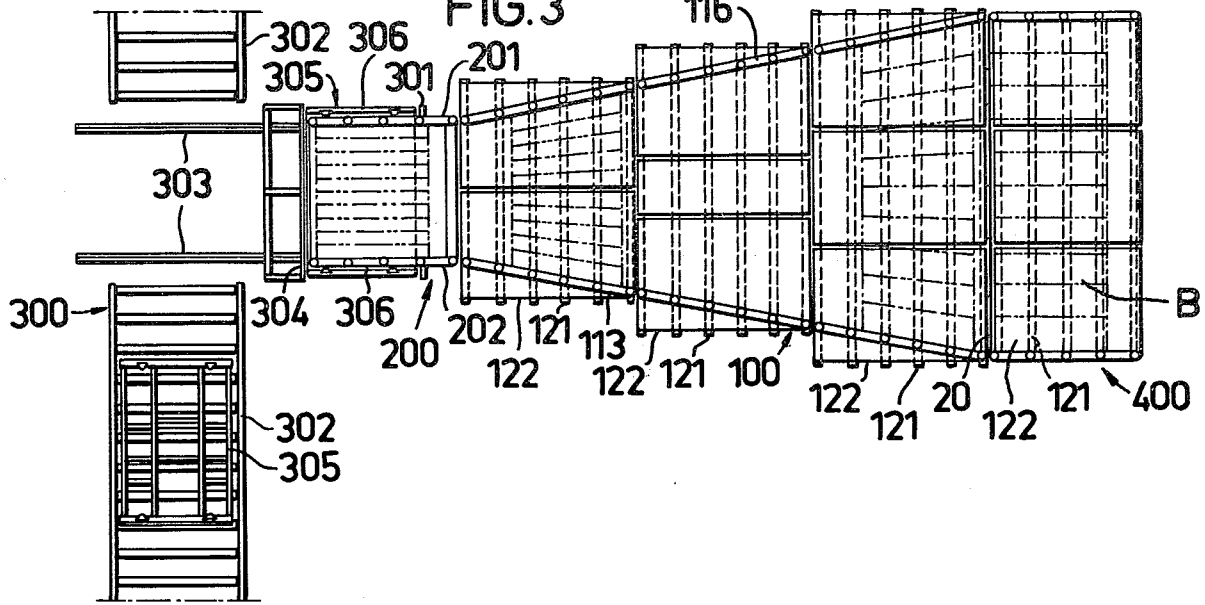
Figure 5:
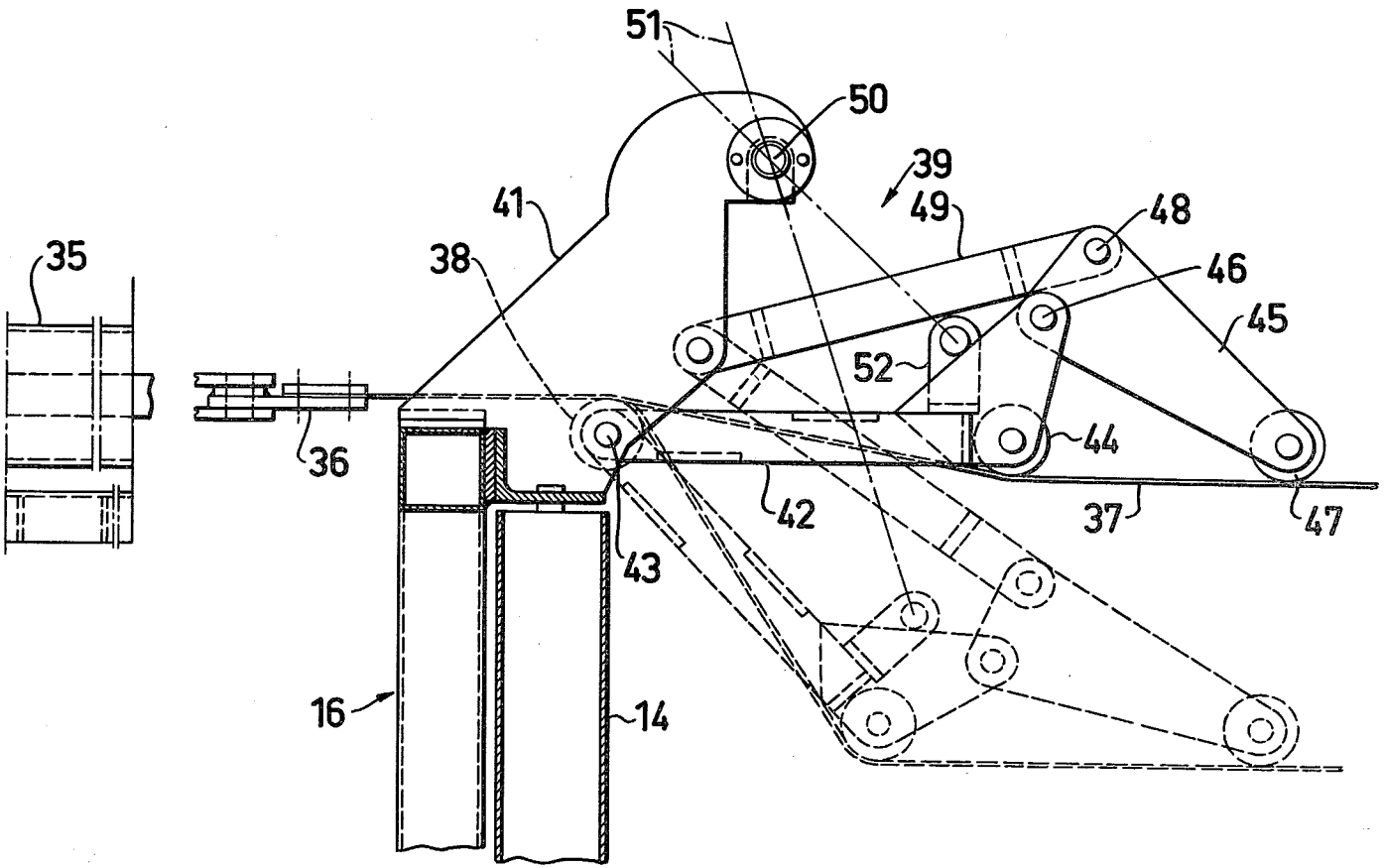

The invention is described in greater detail in the following, with reference to the accompanying drawings, in which FIG. 1 shows a practical application of the invention, FIG. 2 is a lateral view of this embodiment, FIGS. 3 and 4 are a view from above and, respectively, from the side of another embodiment, and FIG. 5 shows a detail of the apparatus according to the invention.

The apparatus comprises a compressing portion 1, a transferring portion 2 and a transporting portion 3. The compressing portion 1 comprises a floor 11, on which the bales or the loose mineral wool sheets to be compressed are stacked. The bales are designated by B and are indicated by dash-dotted lines. On the side of portion 1 remote from the charging side an upright wall 12 is provided in connection to the floor 11. Upright from the floor, furthermore, an end wall 13 is fixed in the space which has the form of a belt conveyor comprising support rolls 15 and conveying belt 14. On the side opposed to the wall 13 a second end wall 16 is provided which in principle is built up in the same way as the wall 13. The wall 13 is supported by a frame 17, and the wall 16 is supported by a frame 18. By means of a hydraulic piston (indicated by 19) it is possible to move the wall 16 in the direction of the arrows. As appears from FIG. 1, an air piston 35 actuated by air pressure is attached to the frame 18. The piston rod of the air piston 35 is attached via a fitting 36 to a wide belt 37, which at its other end is secured on the wall 13. The belt 37 runs over rolls or rollers 38 provided at the wall 13 and, respectively, 16 (see especially FIG. 5) at a belt holder 39 and 40. Said belt holders 39 and 40 being identical as to their design, only the holder 39 will be described in greater detail.

The holder consists of two brackets 41 attached on the wall 16 each on one side of the belt 37. At each bracket 41 an angular arm 42 is hingedly attached about an axle 43, which is in common with the axle for the roller 38. The two angular arms carry between themselves, in the area of their knees, a second roll or roller 44. A triangle-shaped pivot arm 45 is hingedly attached at one corner 46 to the free end of the respective angular arm 42, and the two pivot arms 45 carry between their tips a third roll or roller 47. The other corners 48 of the pivot arms 45 are hingedly connected to the respective bracket 41 each by a joint 49, as clearly appears from FIG. 5. At a rotary axle 50 extending between the upper portions of the brackets an air piston 51 is provided, the piston rod of which is connected rotatably to a mounting lug 52 common to the angular arms 42. It is, thus, possible to lift and lower by the air piston 51 the entire linkage consisting of the angular arms 42, pivot arms 45 and joints 49, so that the rollers 44 and 47 all the time substantially are in a horizontal plane, as clearly appears from the position shown dashed in FIG. 5.

By means of the air piston 35, which can be caused to stretch the belt 37, and by means of the air pistons 51, by which the belt can be pressed down, it is, thus, possible to prevent the material laid into the compressing portion from "raising" during the compressing operation. Due to the location of the roller 47 spaced from the roller 44, an additional depressing area on the belt is obtained, so that the belt more efficiently is pressed down against the material being compressed.

The transferring portion 2 comprises two parallel walls in the form of belt conveyors 21 and 22, which are assembled in the same way as the walls 13 and 16 and carried by a stand 23. The transferring portion further is provided with a floor 24 lying in the same plane as the floor 11.

The walls 13 and 16 of the compressing portion and the walls 21 and 22 of the transferring portion are drivable with the same speed by a motor M. The driving of the wall 16 is coupled in automatically when the wall assumes its position aligned with the wall 22. This coupling-in can be effected by some type of a conventional clutch.

The transporting portion 3 comprises a sledge or carriage 31, which preferably runs on rails (303 in FIG. 3) transverse to a roller conveyor 32 of conventional type. The sledge is provided with a wall 34.

In order to facilitate the understanding of the invention, a compressing procedure is described in the following with reference to FIG. 1.

The bales B are stacked in the compressing portion 1 as indicated in FIG. 1 to a predetermined height (determined by the height of the crates, in which the bales finally will be stored). When the compressing portion is being filled, the belt is stretched by means of the piston 35 and assumes its highest position due to the belt holders 39 and 40 being lifted so as shown in FIG. 1. The stacking is facilitated by the wall 12 and by a wall 20, which by means of a mechanism 52 shown in FIG. 2 can be lifted and lowered in a stand 53, in such a manner, that the walls 12 and 20 form "stop members" and align the bales to be in one and the same plane. When the portion 1 is filled with bales B, the belt holders 39 and 40 as well as the air pistons 51 are actuated so as to move the rollers 44 and 47 downward, whereby the belt, the tension of which can be controlled and adjusted by the piston 35, forms a holding-down and downward compressing "roof" for the bales, while the hydraulic piston 19 is actuated to move the wall 16 in the direction of the arrows, thereby compressing the material in the bales. The belt holder 39 follows along with the wall 16 while maintaining the tension in the belt 37. When the wall 16 assumes the position aligning with the wall 22, the intended compressing of the material is achieved. The wall 20 is lifted and the motor M is started, and at the same time the air pistons 51 lift the linkages whereby the belt is lifted up (by means of the piston 35) from the load of bales now compressed. Owing to the walls 13,16,21,22 constituting the driving of the conveying belts, the package formed of the compressed bales is moved from the compressing portion 1 to the transferring portion 2. Bridging metal sheets 25 facilitate the transfer of the package between the walls 13,21 and, respectively, 16,22. Prior to the start of this procedure or during the same a supply or transport crate 305 (see FIG. 3) resting on the sledge 31 is inserted beneath the floor 24, with the end walls 306 of the crates (FIG. 4) located on the outside each of the wall 21 and 22.

When thus the package moved by the walls 21 and 22 pushes against the wall side 34 of the sledge 31, the sledge and the crate 305 thereon are moved in the transport direction of the package. As the package leaves the transferring portion 2 and the walls 21,22, the material or the bales place themselves against the end walls of the crate whereby they, of course, expand to a certain extent while substantially maintaining their previously obtained compression. The crate, thus, automatically is filled while at the same time being moved to a position aligning with the roller conveyor 32, in which position the package entirely has left the transferring portion.

The filled crate can now be transported away simply.

In FIGS. 3 and 4 another embodiment of the invention is shown, at which the compressing portion 100 seen from above has the shape of a funnel, the walls 113, 116 of which consist as before of belt conveyors. The conveyors, for practical reasons, are divided into sections, as shown three in number. The compressing portion is preceded by a feeding portion 400, in which the bales B are stacked before they are charged into the portion 100. The stacking is facilitated as at the foregoing embodiment by the liftable and lowerable wall 20. The feeding portion 400 and the compressing portion 100 are provided with floors in the form of belt conveyors, which consist of support rolls 121 and conveying belts 122. The transferring portion 200 in principle is identical with the transferring portion 2 as described above. The same applies also to the transporting portion 300, the roller conveyor 302 of which is shown to carry a crate 305. Also the rails 303 guiding the sledge 301 are shown. In order to compress the bales stacked in the feeding portion 400, the walls (belt conveyors) are started, whereby the bales in the form of a package are advanced between the walls while simultaneously being compressed until the package arrives at the transferring portion 200.

In order to prevent the bales at their feeding to be pushed up beyond a height intended for the package, the feeding portion 400 is provided with a collapsible roof in the form of a belt conveyor 401, which is movable by means of a hydraulic device 402 (FIG. 4). In order to prevent the bales at their compressing from being pushed up out of the package, the compressing portion 100 too is provided with a roof in the form of rollers 123.

The invention, of course, can be varied within its scope so that, for example, instead of only the wall 16 (FIG. 1) the two walls 16 and 13 can be moved to effect compression, in which case the walls in the starting position are arranged symmetrically in relation to the transferring portion. Also the crate proper can be equipped with a side corresponding to the wall 34, which in certain cases can be suitable and renders it possible to abandon the sledge 31. The said side needs neither be a complete side, but can consist only of a flange or of a belt extending along one or several edges of the opening formed between the end walls of the crate. The belt conveyors may also be other comparable transport means. The motor M can be replaced by a hydraulic motor for every belt conveyor, and the hydraulic piston (19) can be replaced by a hydraulic motor or an electric motor with chain.

It is to be pointed out that the function described above is only of a schematic nature, and that the entire compressing operation is carried out automatically inclusive of the actuation and de-actuation of pistons and motors. By providing the belt holder 39 with a torque scanner, the belt stretching can be maintained constant and also the pressure of the belt against the bales can be controlled and adjusted as desired. 54 designates the control panel for the machine operation.

If deemed suitable, several belts can be used which operate synchronously with each other.

What we claim is:

1. An apparatus for compressing voluminous easy to compress material comprising a compressing portion consisting of at least one floor and two opposed substantially vertical walls, means to move such walls toward each other so that the material located on the floor between the walls can be compressed to a volume smaller than the original one, at least one belt running over the upper edges of the opposed walls of the compressing portion and being fixed at one end and connected at the other end to a stretching member means to actuate the stretching member to stretch the belt, vertically movable members that act from above on the belt inside the respective wall of the compressing portion to, means to vertically move said members to press on the belt to thereby stretch and synchronously lower the belt between the walls and thereby vertically compress the material, a transferring portion consisting of at least one floor and two opposed, parallel and stationary walls located at such a distance to each other that the respective wall aligns with the walls of the compressing portion when the walls of the compressing portion are in their positions closest to each other, a storage or transport crate with floor and end wall sides in a position for receiving the compressed material being located with its floor beneath the floor of the transferring portion and with its end walls each on a side outside of the walls of the transferring portion, which crate is connected to one side of the opening remote from the transferring portion between the end walls of the crate.

2. An apparatus as defined in claim 1, wherein the walls of the compressing portion and transferring portion consist of belt conveyors.

3. An apparatus as defined in claim 1, wherein the vertically movable members each consist of a roll carried at the ends by two arms pivotal at the upper edge of the wall, the movement of which arms is controlled by an air piston acting between the wall and the arms.

4. An apparatus as defined in claim 3, wherein an additional roll is provided on the side remote from the wall of the compressing portion, in parallel with and spaced from said roll and in a horizontal plane through the same, and the additional roll by means of a linkage so pivots with the first-mentioned roll, that the rolls substantially always are in the same horizontal plane.

5. An apparatus as defined in claim 4, wherein the linkage which comprises an arm and two joints are hinged at two brackets attached upright to the upper edge of the wall of the compressing portion, the upper ends of which brackets are interconnected and form a support for the cylinder of the air piston.

6. An apparatus as defined in claim 3, wherein the walls of the compressing portion are in parallel with each other, and one wall is movable perpendicularly to the other wall.

7. An apparatus as defined in claim 3, wherein both of the walls of the compressing portion move towards each other in the direction of the transferring portion.

* * * * *